US009021840B2

(12) United States Patent
Andrews

(10) Patent No.: US 9,021,840 B2
(45) Date of Patent: May 5, 2015

(54) GUN SAFE

(71) Applicant: Thomas Andrews, Provo, UT (US)

(72) Inventor: Thomas Andrews, Provo, UT (US)

( * ) Notice: Subject to any disclaimer, the term of this patent is extended or adjusted under 35 U.S.C. 154(b) by 0 days.

(21) Appl. No.: 13/685,545

(22) Filed: Nov. 26, 2012

(65) Prior Publication Data

US 2013/0133558 A1 May 30, 2013

Related U.S. Application Data

(60) Provisional application No. 61/563,732, filed on Nov. 25, 2011.

(51) Int. Cl.
*E05B 65/52* (2006.01)
*E05G 1/00* (2006.01)

(52) U.S. Cl.
CPC ..... *E05G 1/00* (2013.01)

(58) Field of Classification Search
USPC ..... 70/63, 158–162, 278; 109/45, 47, 50, 109/59 R, 69, 70
See application file for complete search history.

(56) References Cited

U.S. PATENT DOCUMENTS 1,423,804 A * 7/1922 Kontorowitz ..... 5/308
4,788,838 A * 12/1988 Cislo ..... 70/63
4,869,449 A * 9/1989 Goodman ..... 248/205.1
5,009,088 A * 4/1991 Cislo ..... 70/63
5,056,342 A * 10/1991 Prinz ..... 70/63
5,111,545 A * 5/1992 Krozal ..... 5/503.1
5,317,888 A * 6/1994 Towns ..... 70/63
5,329,865 A * 7/1994 McWard ..... 109/50
5,713,650 A * 2/1998 King et al. ..... 70/63
7,299,667 B1 * 11/2007 Miresmaili ..... 70/58
8,186,188 B1 * 5/2012 Brown ..... 70/63
8,327,777 B2 * 12/2012 Heim et al. ..... 109/73

* cited by examiner

*Primary Examiner* — Christopher Boswell
(74) *Attorney, Agent, or Firm* — Michael F. Krieger; Kirton McConkie

(57) ABSTRACT

A gun safe is configured to be mounted underneath a portion of an item of furniture and to be deployable from a storage position underneath the portion of the item of furniture into a readily-accessible position adjacent the item of furniture. The gun safe includes a lockable container sized to receive a weapon therein and an articulating mount configured to secure the lockable container underneath the portion of the item of furniture in the storage position. The articulating mount includes a fixed element configured to be fixed underneath the portion of the item of furniture and an articulating element attached between the fixed element and the lockable container, the articulating element being configured to facilitate movement of the lockable container from the storage position outward and upward to a deployed position adjacent the item of furniture.

20 Claims, 11 Drawing Sheets

GUN SAFE

CROSS-REFERENCE TO RELATED APPLICATIONS

This application claims the benefit of U.S. Provisional Application No. 61/563,732, filed Nov. 25, 2011, which is incorporated herein by reference.

BACKGROUND OF THE INVENTION

1. Field of the Invention

The present invention relates to gun safes, and more particularly to a gun safe mounted under a piece of furniture and deploying from its mounted location to an easily-accessible location.

2. Background and Related Art

Due to a risk of burglaries, thefts, and other crimes specifically directed at homes or residences, there has been a desire to have firearms or other weapons available in the home for purposes of self-protection. There is, of course, an obvious danger in keeping loaded firearms or other weapons in the home. Such danger frequently results in harm or even death to small children or others unauthorized to handle the weapons when such child or unauthorized person has access to them. Therefore, the owner or authorized user of the firearm frequently stores the weapon at a location which is not readily accessible in emergency conditions so as to prevent access thereto by small children or unauthorized persons. This, of course, defeats the purpose of having a firearm in the home since such firearm or like weapon is frequently useless unless the owner or user has quick and ready access to the weapon.

Since home or residence directed crimes more frequently occur in the evening when the occupants are sleeping, it is an obvious benefit to maintain the firearm at a location which is readily accessible when one is sleeping. Accordingly, there is a need in this area for a safety box or security container which will prevent unauthorized access to the firearm but allow the authorized user to access the firearm, or like weapon, in a quick and efficient manner during emergency conditions such as a break in or the like.

BRIEF SUMMARY OF THE INVENTION

A gun safe is configured to be mounted underneath a portion of an item of furniture and to be deployable from a storage position underneath the portion of the item of furniture into a readily-accessible position adjacent the item of furniture. The gun safe includes a lockable container sized to receive a weapon therein and an articulating mount configured to secure the lockable container underneath the portion of the item of furniture in the storage position. The articulating mount includes a fixed element configured to be fixed underneath the portion of the item of furniture and an articulating element attached between the fixed element and the lockable container, the articulating element being configured to facilitate movement of the lockable container from the storage position outward and upward to a deployed position adjacent the item of furniture.

The articulating element may be configured to facilitate movement of the lockable container substantially outward until the lockable container is substantially adjacent the item of furniture and wherein the articulating element is further configured to facilitate movement of the lockable container substantially upward once the lockable container is substantially adjacent the item of furniture. The fixed element may be securable to an underside of the item of furniture, or may be configured to rest on or attach to a surface underlying the item of furniture.

The articulating mount may include a lateral displacement element configured to provide lateral displacement of the lockable container between the storage position and a low position adjacent the item of furniture. The articulating mount may also include a vertical displacement element configured to elevate the lockable container from the low position adjacent the item of furniture to an elevated position adjacent the item of furniture to facilitate access to the lockable container. The vertical displacement element may be configured to permit a gravitational force to bias the lockable container to the low position. A reversible latching mechanism may be provided to latch the lockable container in the elevated position.

The lockable container may be sized to accommodate a firearm. The item of furniture may be a bed having a bed frame, and the gun safe may be configured to be secured to the bed frame. When the lockable container is in the storage position, a major portion of the lockable container is substantially hidden from view by the item of furniture.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
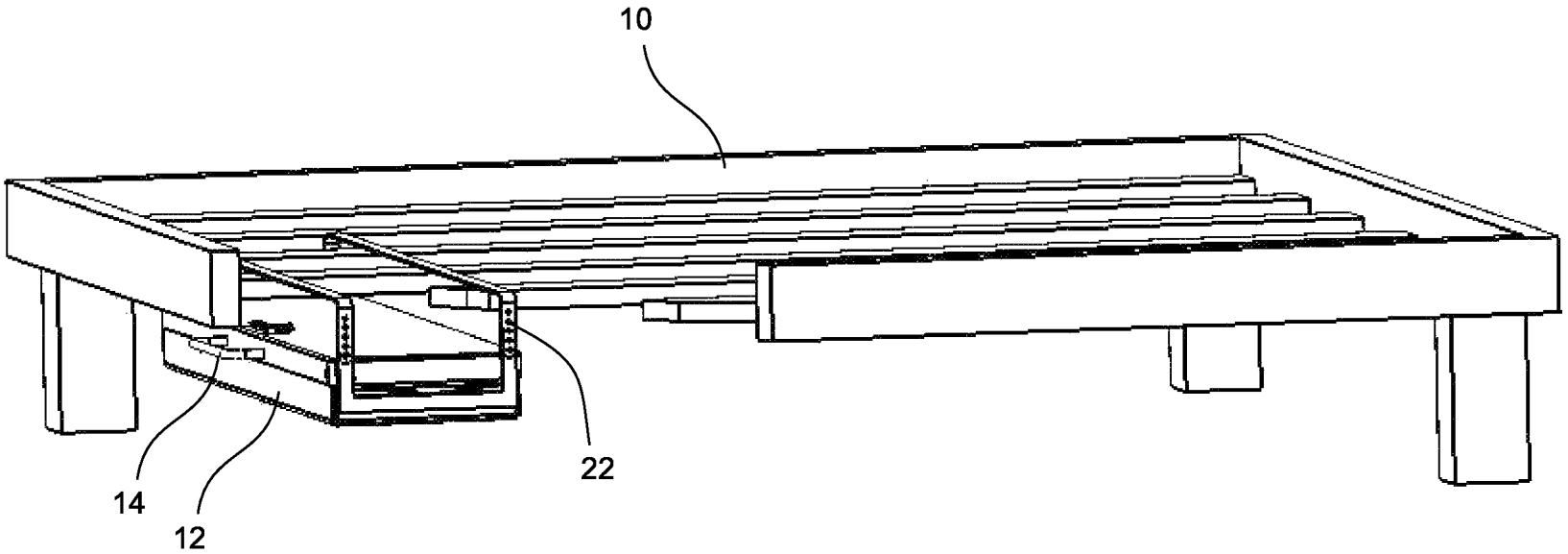
FIG. 1 shows a perspective view of a representative gun safe in accordance with embodiments of the invention underneath a representative item of furniture, specifically, a bed.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

According to embodiments of the invention, a gun safe is configured to be mounted underneath a portion of an item of furniture and to be deployable from a storage position underneath the portion of the item of furniture into a readily-accessible position adjacent the item of furniture. The gun safe includes a lockable container sized to receive a weapon therein and an articulating mount configured to secure the lockable container underneath the portion of the item of furniture in the storage position. The articulating mount includes a fixed element configured to be fixed underneath the portion of the item of furniture and an articulating element attached between the fixed element and the lockable container, the articulating element being configured to facilitate movement of the lockable container from the storage position outward and upward to a deployed or raised position adjacent the item of furniture.

The articulating element may be configured to facilitate movement of the lockable container substantially outward until the lockable container is substantially adjacent the item of furniture and wherein the articulating element is further configured to facilitate movement of the lockable container substantially upward once the lockable container is substantially adjacent the item of furniture. The fixed element may be securable to an underside of the item of furniture, or may be configured to rest on or attach to a surface underlying the item of furniture.

The articulating mount may include a lateral displacement element configured to provide lateral displacement of the lockable container between the storage position and a low position adjacent the item of furniture. The articulating mount may also include a vertical displacement element configured to elevate the lockable container from the low position adjacent the item of furniture to an elevated position adjacent the item of furniture to facilitate access to the lockable container. The vertical displacement element may be configured to permit a gravitational force to bias the lockable container to the low position. A reversible latching mechanism may be provided to latch the lockable container in the elevated position.

The lockable container may be sized to accommodate a firearm. The item of furniture may be a bed comprising a bed frame, and the gun safe may be configured to be secured to the bed frame. When the lockable container is in the storage position, a major portion of the lockable container is substantially hidden from view by the item of furniture.

Gun safes in accordance with embodiments of the invention may be configured and sized to be used with and to accommodate a variety of sizes and shapes of weapons such as guns and other firearms, and may further be configured and sized to be used with and to accommodate features of a variety of items of furniture. As such, it should be understood that the embodiments specifically illustrated and discussed herein are intended to be illustrative of the features and concepts embodied in the illustrated embodiments only, and are not to be taken as limiting of the invention. For example, the illustrated embodiments show a gun safe having a lockable container sized to accommodate a shotgun, rifle, or other shoulder-fired firearm. Many users may not wish to have a gun safe of this size and may instead prefer a smaller gun safe with a lockable container sized to accommodate one or a few handguns, and gun safes so sized are embraced within the scope of embodiments of the invention. Similarly, gun safes of any size, whether larger or smaller than those illustrated or discussed herein are embraced within the scope of embodiments of the invention.

Additionally, embodiments of the invention will be described below with reference to a bed serving as an item of furniture under which the lockable container may be stowed in a storage position and from under which the lockable container may be deployed to permit ready access to any contained firearms or other weapons. The illustrated bed is only one example of an item of furniture with which embodiments of the gun safe may be associated. Other embodiments (sized appropriately) may be used with a variety of other types of furniture, such as couches, chairs, tables and nightstands, and any other appropriate furniture items. Where desired, the lockable container of embodiments of the invention may be formed or covered so as to blend in with such furniture items, and embodiments of the invention may be built in to any such items of furniture.

Finally, while the embodiments of the invention discussed herein are referred to as gun safes having a lockable container, it should be understood that the embodiments of the invention may be used to store any type of desired items, and need not be limited to the storage of firearms, guns, or weapons of other types. The embodiments of the invention may be used to store and permit access to any of a variety of other items, including valuables, documents, or any conceivable items. Thus, the use of the terms "gun safe," "gun," "weapon," "firearm," and the like should be read broadly and for convenience in referring to embodiments of the invention and is not intended to limit use of embodiments of the invention.

Figure 2:
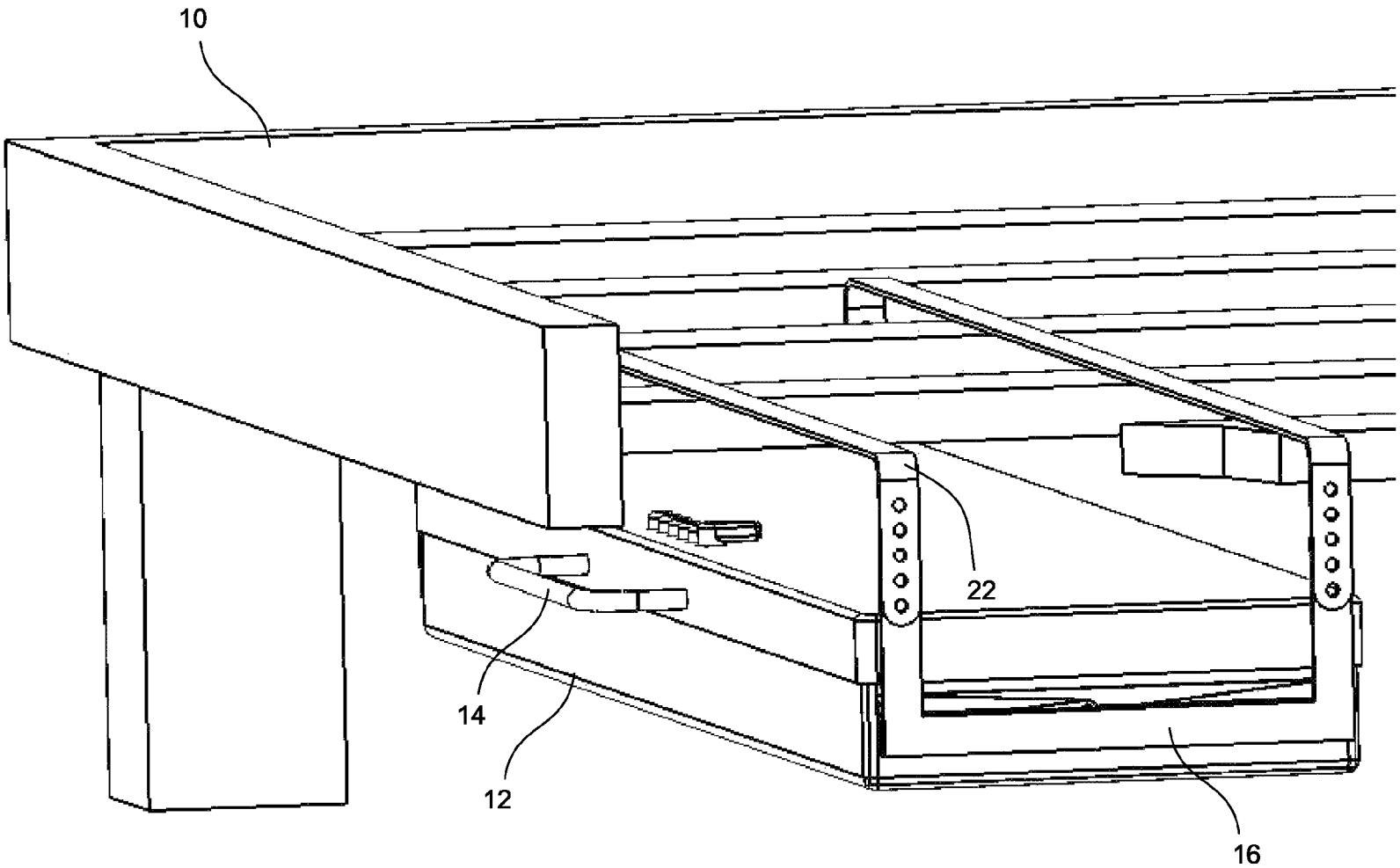
FIG. 2 shows an enlarged view of a portion of FIG. 1.

FIG. 1 shows an embodiment of a gun safe in a storage position underneath a bed 10. FIG. 2 also shows a similar view, with the area around the gun safe enlarged to facilitate viewing the embodiment. For ease of illustration and understanding of the embodiment of the gun safe, the bed 10 shown in the Figures is shown partially cut away. The bed 10 is one example of an item of furniture, and it includes a bed frame including legs that elevate a mattress-supporting portion of the bed frame above an underlying surface. When the gun safe is in the storage position, it is substantially entirely disposed between the bed frame and the underlying surface, as shown in FIGS. 1 and 2, such that the gun safe is largely or substantially hidden from view. Although not illustrated in FIG. 1, the gun safe may be further hidden from view by blankets, sheets, quilts, comforters, and the like that may be on the bed, as may be readily appreciated. Alternatively, and also not illustrated, more-visible portions of the gun safe (e.g. the front of the gun safe) may be formed, covered, or camouflaged so as to be less noticeable and/or so as to be presumed to be part of the bed 10.

The gun safe includes a lockable container 12. Disposed on the lockable container 12 is a handle 14 that may be grasped by a user and used to effectuate movement of the lockable container 12. As may be appreciated from FIG. 2, the lockable container 12 may take the form of any of a variety of standard lockable containers such as of the types used to secure firearms, weapons, valuables, and other items, and may be of any desired size and shape. In the illustrated embodiment, the lockable container 12 is rectangular, and has sides and a bottom defining and enclosing a volume, as well as a lockable lid that can be closed and locked to safely contain items within the enclosed volume, and that can be selectively unlocked and opened to permit access to the enclosed contents, as is well known in the art.

The lockable container 12 therefore includes one or more locks, which may be of any desired lock mechanism now known in the art or later invented. For example, the one or more locks may include a combination lock, a key lock, a biometric lock, a magnetic lock, a keycard lock, a radio-device lock, or any other type of lock allowing a user to restrict or limit access to the contents of the lockable container 12. Locking the lockable container 12 allows a gun owner to restrict access to any guns contained in the lockable container 12 (such as from children or persons unqualified to use such gun or guns), while the disposition of the lockable container 12 under the bed 10 allows the user to have rapid access to the contents of the lockable container 12 in time of need, as will be discussed further below.

Figure 3:
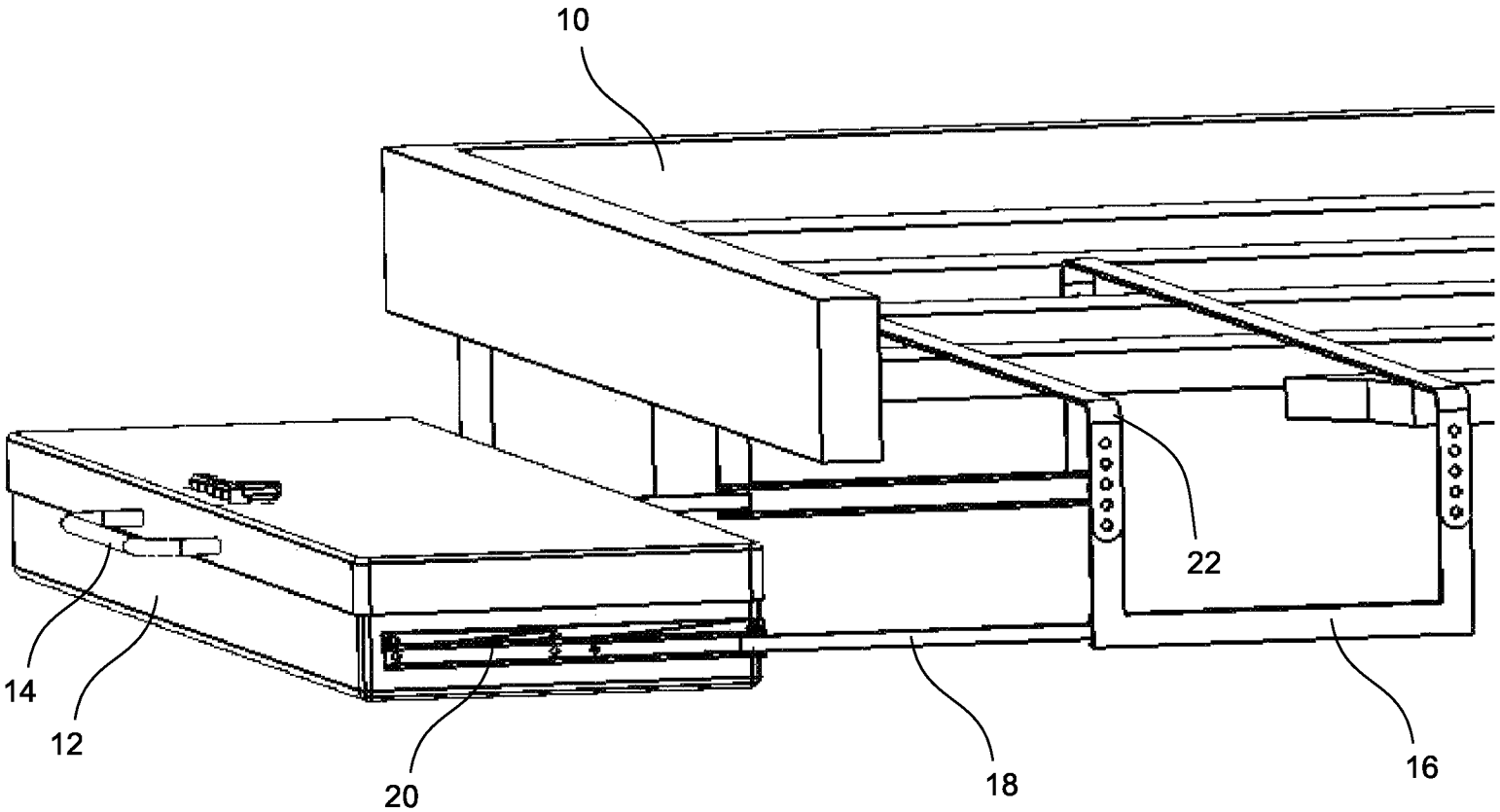
FIG. 3 shows a perspective view of a representative gun safe wherein a lockable container of the gun safe has been deployed to a low position adjacent the bed of FIG. 1.
Figure 4:
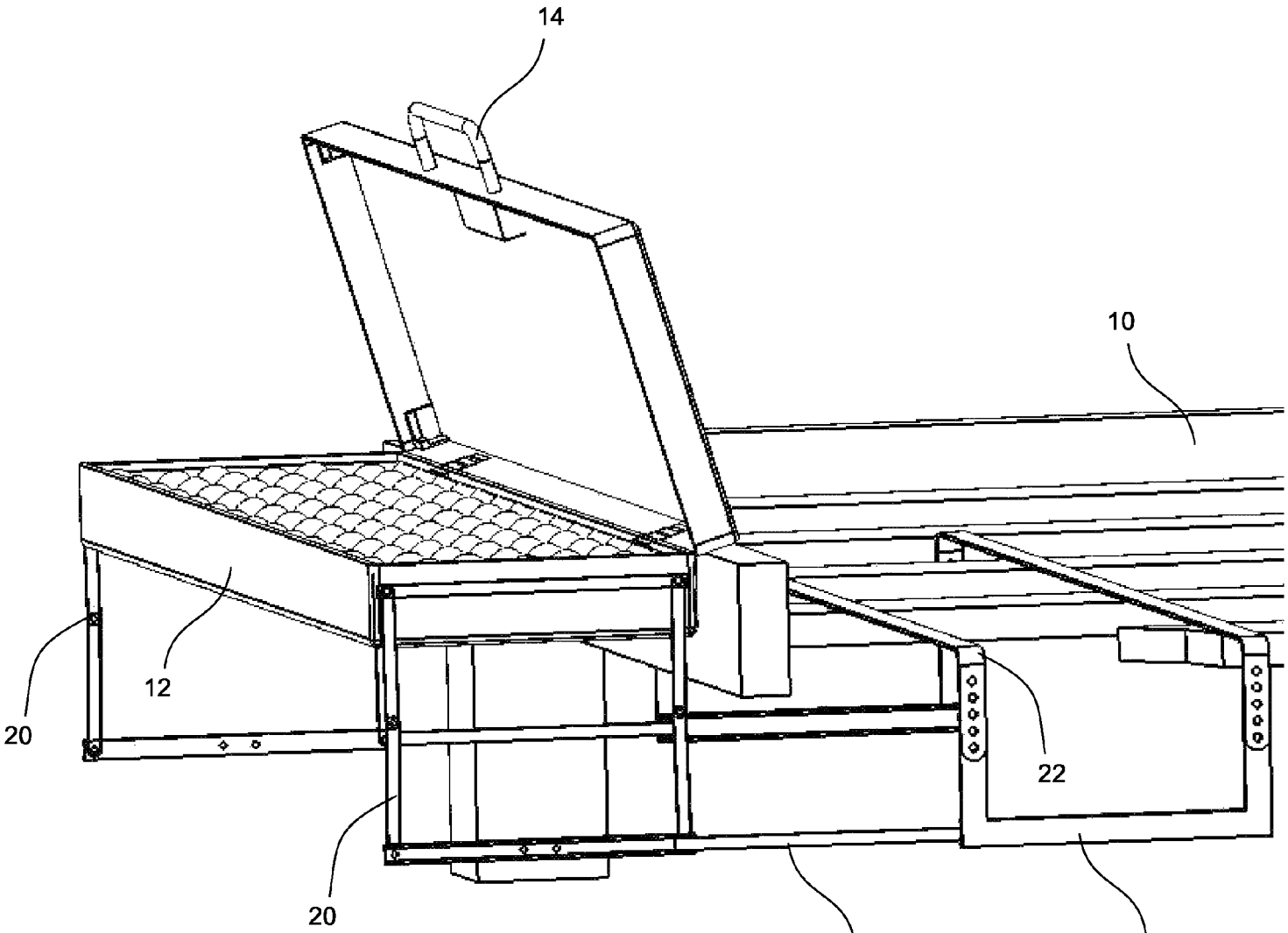
FIG. 4 shows a perspective view of the representative gun safe wherein the lockable container of the gun safe has been deployed to an elevated position adjacent the bed of FIG. 1 and wherein the lockable container is opened.
Figure 5:
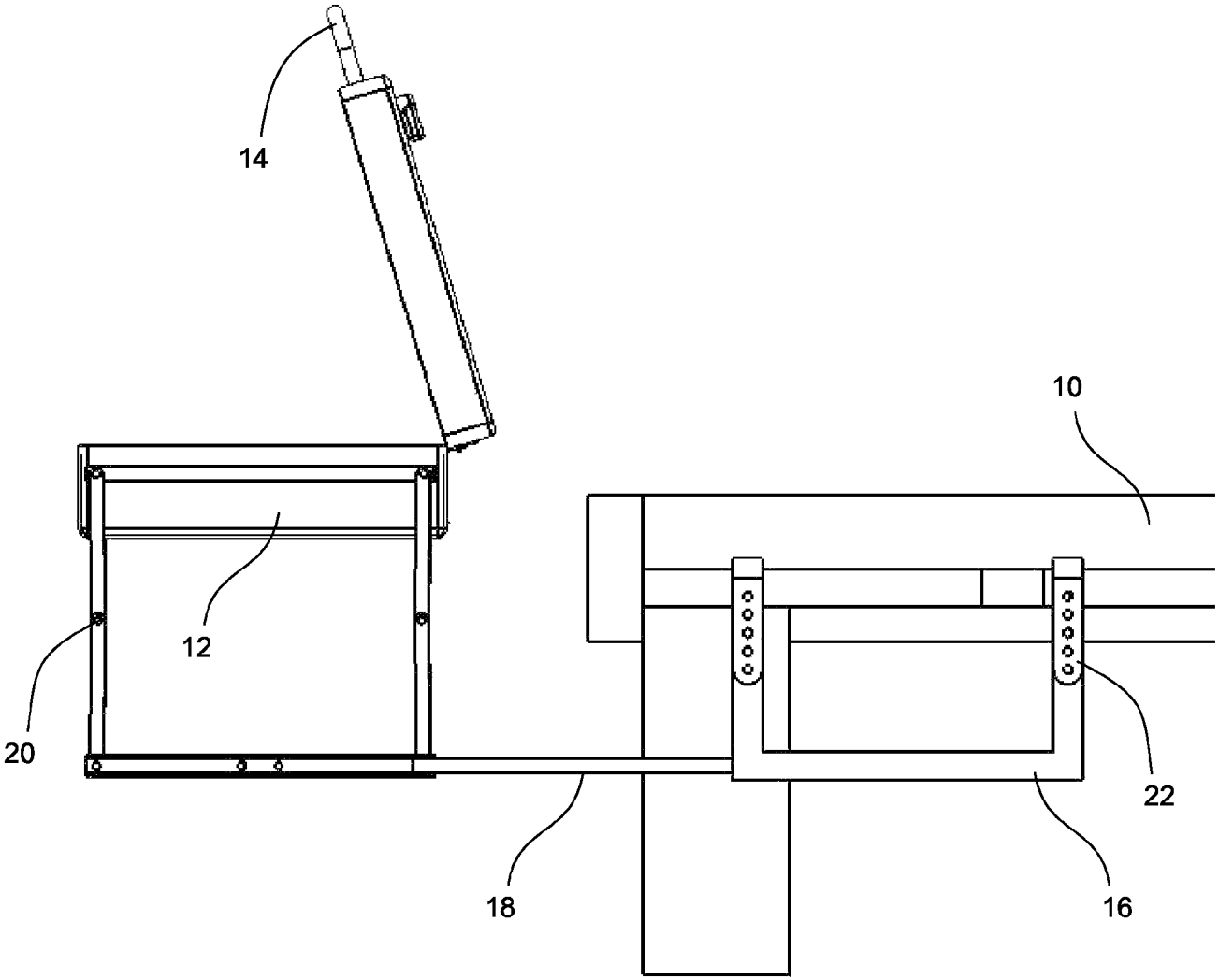
FIG. 5 shows a side view of the representative gun safe in the position shown in FIG. 4.

The lockable container 12, in the storage position shown in FIGS. 1 and 2, is conveniently out of the way, thereby saving space and avoiding clutter when compared with the use of standard gun safes. However, it will be recognized that attempting to access contents of the lockable container 12 while the lockable container 12 remains in the storage position would be awkward at best. Therefore, embodiments of the invention provide for rapid and easy movement of the lockable container 12 from the storage position to a position for ready access to the contents of the lockable container 12 adjacent to the bed 10 or other item of furniture. The handle 14 facilitates this movement, whereby the user grasps the handle 14, pulls the lockable container 12 outward from the storage position until the lockable container 12 is substantially adjacent the bed 10 or other item of furniture and clears the bed frame, as shown in FIG. 3. While such a position may permit access to the lockable container 12, it may be more desirable or more comfortable to access the lockable container 12 at an elevated position. Therefore, the user may then pull the lockable container 12 upward to a readily-accessible position also adjacent the bed, and may then open the lockable container 12, as shown in FIGS. 4 and 5.

To permit and facilitate these movements, the lockable container 12 is attached to an articulating mount 16 as shown in FIGS. 1-6. The articulating mount 16 secures the lockable container 12 underneath a portion of the bed 10 in the storage position, and includes a fixed element configured to be fixed underneath the item of furniture. In some embodiments, the fixed element is configured to be secured to an underside of the bed 10 or other item of furniture. In other embodiments, the fixed element is configured to rest on or be secured to a surface underlying the bed 10 or other item of furniture.

One or more articulating elements is connected between the fixed element and the lockable container 12. The articulating element is configured to facilitate movement of the lockable container 12 from the storage position as shown in FIGS. 1-2 outward and upward to a raised or deployed position as shown in FIGS. 4 and 5 where the lockable container 12 is readily accessible. The articulating element may be formed of any of a variety of movement elements and components configured to support the lockable container 12 and provide the types of movement discussed herein, and the invention is not limited to the specific elements and components discussed herein and shown in the Figures. Rather, the elements and components discussed herein and shown in the Figures are intended to illustrate features of embodiments of the invention and illustrative manners in which embodiments of the invention may be constructed.

The articulating element of the illustrated embodiment may be formed of two individual elements, a lateral displacement element 18 and a vertical displacement element 20. The lateral displacement element 18 facilitates movement of the lockable container 12 substantially outward until the lockable container 12 is substantially adjacent the bed 10 or other item of furniture in a low position as shown in FIG. 3. The lateral movement may be provided by any type of component known in the art to provide such motion, including ball bearing glides, wheels and guides, a multi-bar linkage (such as a scissors linkage), and other similar mechanisms, including any of a variety of linkages and mechanisms now known or later invented that permit lateral movement of the lockable container 12 from the storage position of FIGS. 1 and 2 to a laterally displaced position approximately similar to that shown in FIG. 3. As may be appreciated, the lateral displacement may be linear or only approximately linear depending on the mechanism chosen. The lateral displacement element 18 shown in FIGS. 1-4 as an example is a ball bearing glide. Regardless of the mechanism(s) or device(s) chosen for the lateral displacement element 18, the lateral displacement element 18 is sized and configured to support the weight of the lockable container 12 during the lateral displacement movement.

Once the lockable container 12 is in the low position shown in FIG. 3, the user naturally tends to pull upward on the lockable container 12, using the handle 14. The vertical displacement element 20 facilitates substantially upward movement of the lockable container 12 from the low position of FIG. 3 to an elevated position for easier access as shown in FIGS. 4 and 5. The vertical displacement element 20 may also be formed of any of a variety of mechanisms permitting a desired type of motion while maintaining the lockable container 12 in a desired orientation (e.g. substantially horizontal). Examples of such mechanisms include those discussed above with respect to the lateral displacement element 18, although it may be appreciated that the vertical displacement element 20 at least includes a feature, element, or configuration that reasonably secures the lockable container 12 in the elevated position such that the lockable container 12 does not fall back down in an unwanted fashion while being accessed.

Because the lockable container 12 may have significant weight, the vertical displacement element 20 may optionally include a feature, element, or configuration that assists in raising the lockable container 12 by at least supporting a significant portion of the weight of the lockable container such that vertical displacement of the lockable container becomes much easier. Examples of such features, elements, or configurations include gas-charged cylinders, springs, or any other element known in the art. In some embodiments, such features, elements, or configurations may be adjustable to account for variations in the weight of the lockable container 12 due to changing contents of the lockable container 12. Such features, elements, or configurations are not specifically illustrated in the Figures, but selection and placement of such features, elements, or configurations will become apparent to one of skill in the art from the foregoing discussion and the Figures, and from practicing embodiments of the invention.

Regardless, such features, elements, or configurations may also be sized or chosen such that when the lockable container 12 is in the low position, the force of gravity is sufficient to keep the lockable container 12 in the low position. In other words, such features, elements, or configurations may assist the user in elevating the lockable container 12, but need not be so large that the lockable container 12 naturally springs upward when it is withdrawn from under the bed 10 or other item of furniture. Of course, if such action were desired, such features, elements, or configurations could be sized accordingly.

If such features, elements, or configurations are properly sized, and if the vertical displacement element 20 is properly designed, such features, elements, or configurations may sufficiently support the lockable container 12 in the elevated position. This may be the case regardless of whether such features, elements, or configurations are sized to cause the lockable container 12 to naturally spring upward from the low position. Nevertheless, as it is envisioned that it will be desirable to ensure that the lockable container 12 remains in the elevated position for as long as desired, the vertical displacement element assembly may be provided with a reversible latching mechanism that latches the lockable container 12 in the elevated position. Any type of suitable mechanism may be used for the latching mechanism 24. The latching mechanism may also include a release mechanism that may be affixed to the lockable container 12 or to any other desirable location (such as a strategically placed foot pedal) and that may be activated to unlatch the lockable container 12 so that it may be lowered from the elevated position.

In use, the gun safe is located and/or secured under the bed 10 or other item of furniture as shown in FIGS. 1 and 2. When the contents of the gun safe are to be accessed, the lockable container 12 is withdrawn laterally from under the bed 10 or other item of furniture (using the lateral displacement element 18) until the lockable container 12 clears the side of the bed 10 or other item of furniture and is in the low position shown in FIG. 3. Then, the user pulls upward on the lockable container 12, causing substantially upward movement (which may or may not include some lateral movement, depending on the construction of the vertical displacement element 20 and/or whether additional movement is permitted by the lateral displacement element 18) of the lockable container 12. When the lockable container 12 reaches the elevated position, the latching mechanism, if any, engages, securing the lockable container 12 in the elevated position shown in FIGS. 4 and 5.

Once the lockable container 12 is in the elevated position, the user accesses the contents of the lockable container 12 by disengaging the lock or locking mechanism securing the lid or other closing element of the lockable container 12 by any appropriate method (e.g. key, code entry, biometric scan, etc.) and by opening the lid. The entire process of accessing the contents of the lockable container 12 may take mere seconds, while the contents of the lockable container 12 are otherwise secured from use. Thus, a user disturbed from sleep by an intruder can quickly and easily access means for self defense without placing his or her household at risk from unauthorized and unskilled use of the same means for self defense.

When the gun safe is to be secured again, the user locks the lockable container 12, as is known in the art, actuates the release mechanism, if any, to release the latching mechanism, if any, and either allows gravity to return the lockable container 12 to the low position shown in FIG. 3 or gently applies a downward force to the lockable container 12 until the low position is achieved. Thereafter, the user pushes the lockable container 12 back under the bed 10 or other item of furniture, thereby engaging the lateral displacement element 18 and restoring the lockable container 12 to the storage position shown in FIGS. 1 and 2.

The vertical displacement element 20 allows substantially upward movement without substantially modifying the orientation of the lockable container 12 (i.e. the lockable container 12 does not significantly tilt). The contents of the lockable container 12 may be accessible in either of the low or elevated positions, and the contents of the lockable container 12 are not substantially disturbed during the described movements of the lockable container 12 by significant orientation changes (e.g. tilting) of the lockable container 12.

In the illustrated embodiment, two vertical displacement elements 20 and two lateral displacement elements 18 are present to properly support the illustrated lockable container 12, one set on either side of the lockable container 12. It should be understood that any desirable and effective number of vertical displacement elements 20 and/or lateral displacement elements 18 may be used to provide adequate and sufficient support for each particular size and shape of lockable container 12. Thus, if the lockable container 12 is lighter and more compact, a single vertical displacement element 20 and a single lateral displacement element 18 might be used. Alternatively, if the lockable container 12 is more massive, more than two vertical displacement elements 20 and more than two lateral displacement elements might be used. It will also be appreciated that the number of lateral displacement elements 18 and the number of vertical displacement elements 20 need not be the same, but may vary depending on the configuration, size, and elements chosen.

The foregoing description and FIGS. 1-4 illustrate the lateral displacement element 18 and the vertical displacement element 20 as mechanisms or elements that function independently. That is to say that the lateral displacement occurs independently from the vertical displacement. This function is caused by selection of the lateral displacement element 18 and the vertical displacement element 20 as independently actuated mechanisms or elements. It should be appreciated that the lateral displacement element 18 and the vertical displacement element 20 may instead be provided as a unitary mechanism to provide a complex and smooth motion between the storage position of FIGS. 1 and 2 and the elevated accessible position of FIGS. 4 and 5 without providing a discrete low position such as shown in FIG. 3. For example, the lateral displacement element 18 and the vertical displacement element 20 may be jointly formed of a multi-bar mechanism configured to provide a complex motion to provide sufficient lateral motion from the storage position illustrated in FIGS. 1 and 2 in a low position, without significant vertical displacement, to allow the lockable container 12 to clear the side of the bed 10 from the storage position, followed by largely vertical motion, with only minimal to moderate additional lateral displacement, upward to the raised position illustrated in FIGS. 4 and 5.

Figure 6:
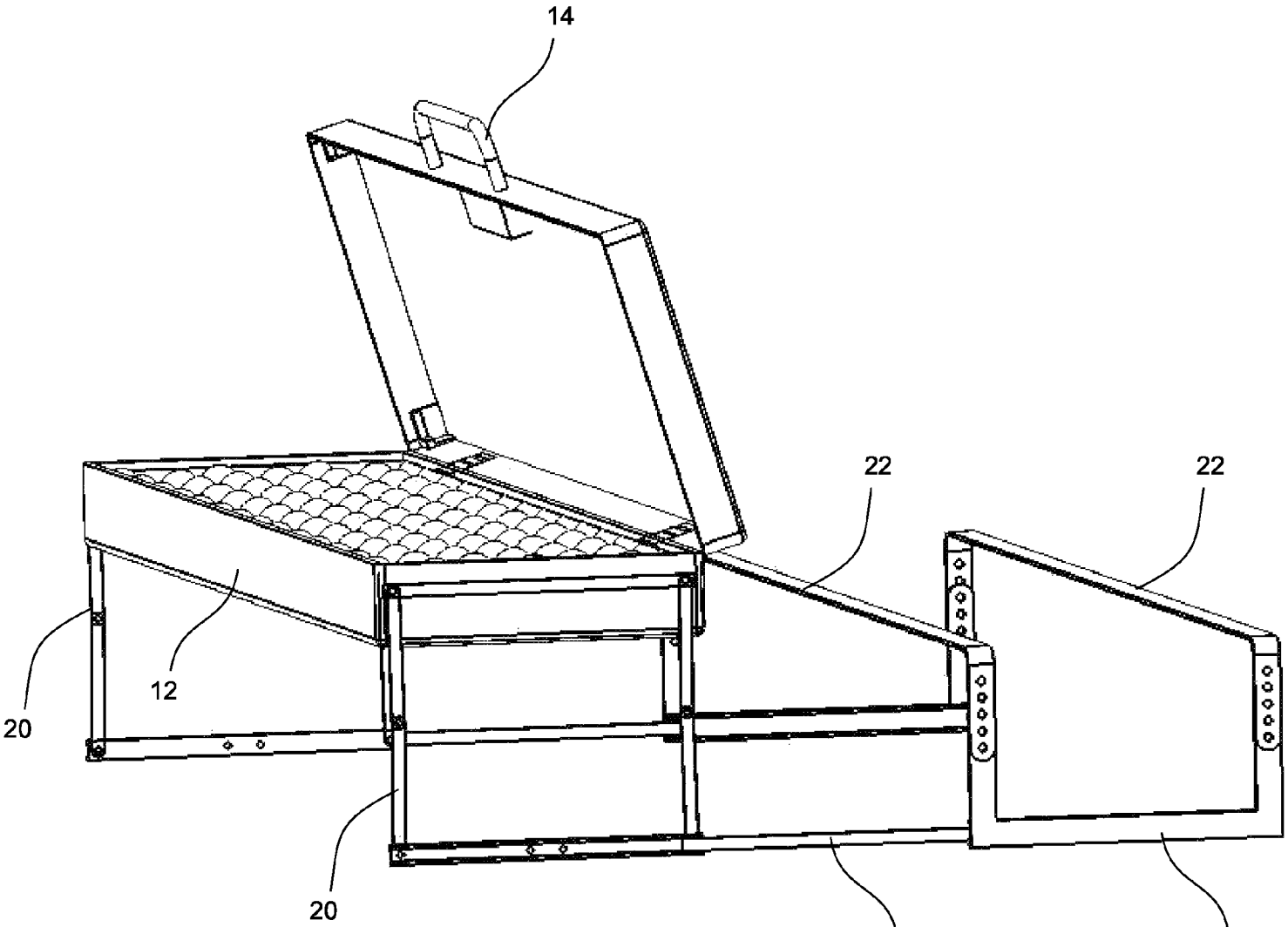
FIG. 6 shows a perspective view of the representative gun safe of FIG. 4 with the item of furniture omitted.
Figure 7:
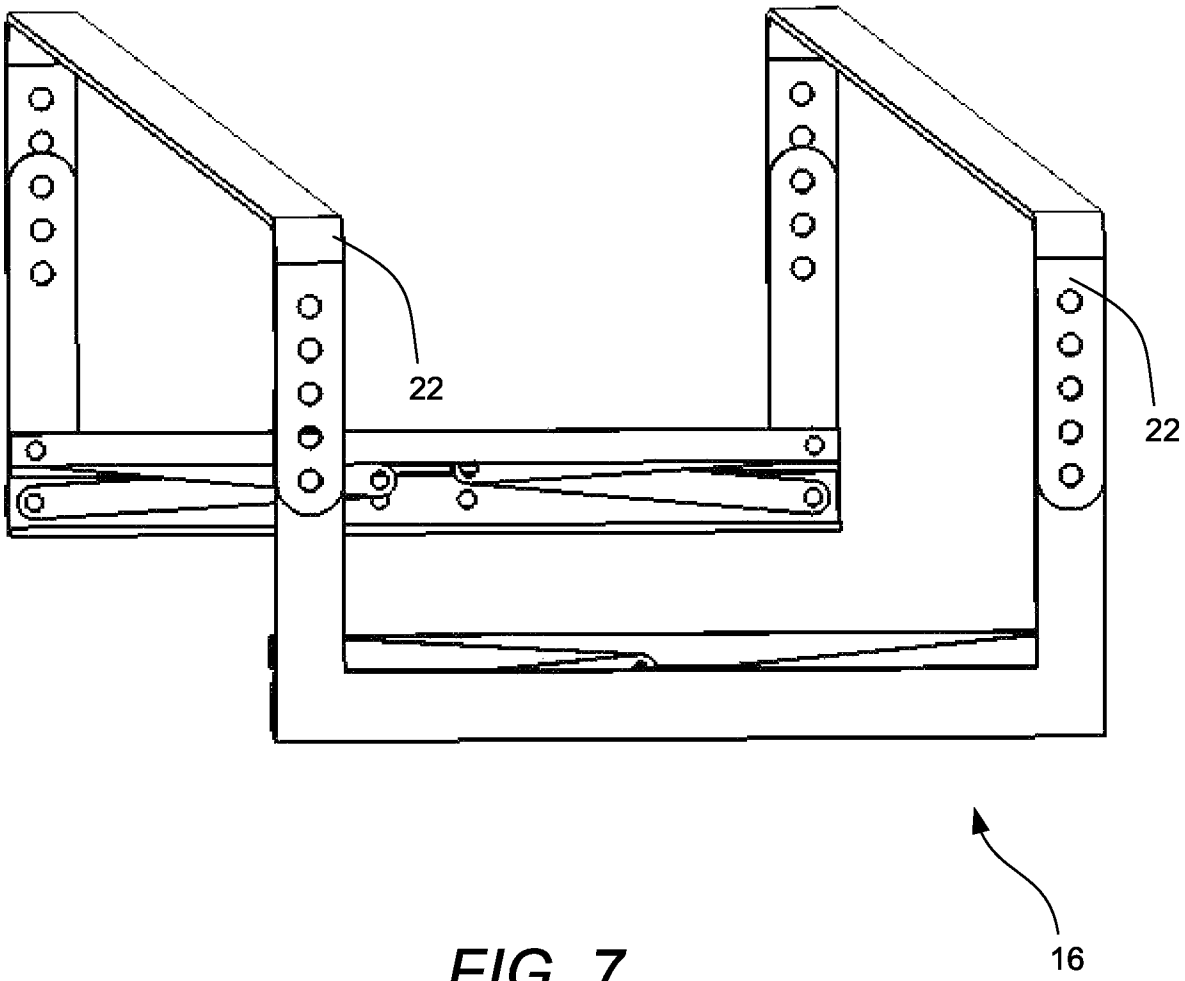
FIG. 7 shows a perspective view of an articulating mount from the gun safe of FIGS. 1-6 in the position of FIGS. 1 and 2.
Figure 8:
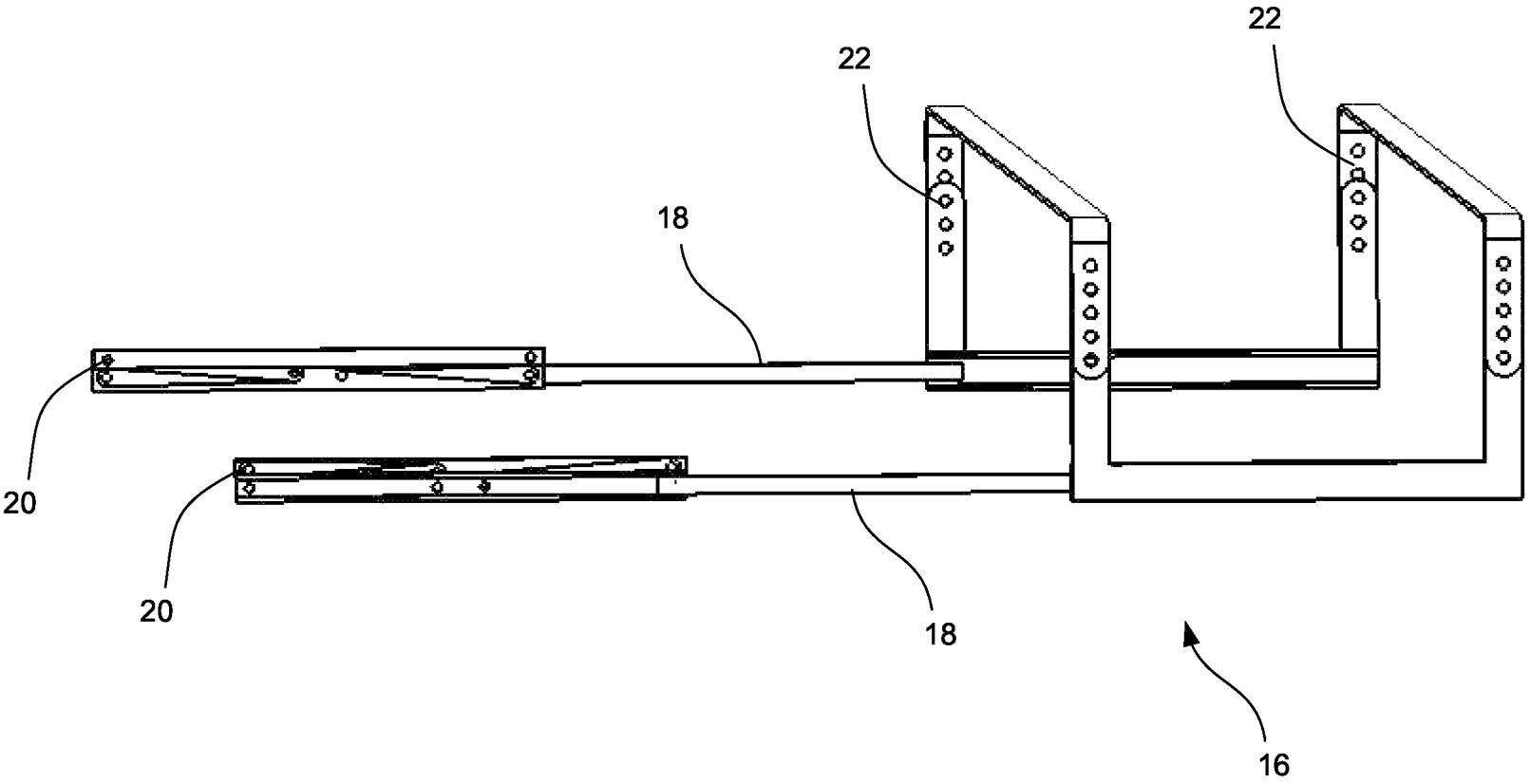
FIG. 8 shows a perspective view of an articulating mount from the gun safe of FIGS. 1-6 in the position of FIG. 3.
Figure 9:
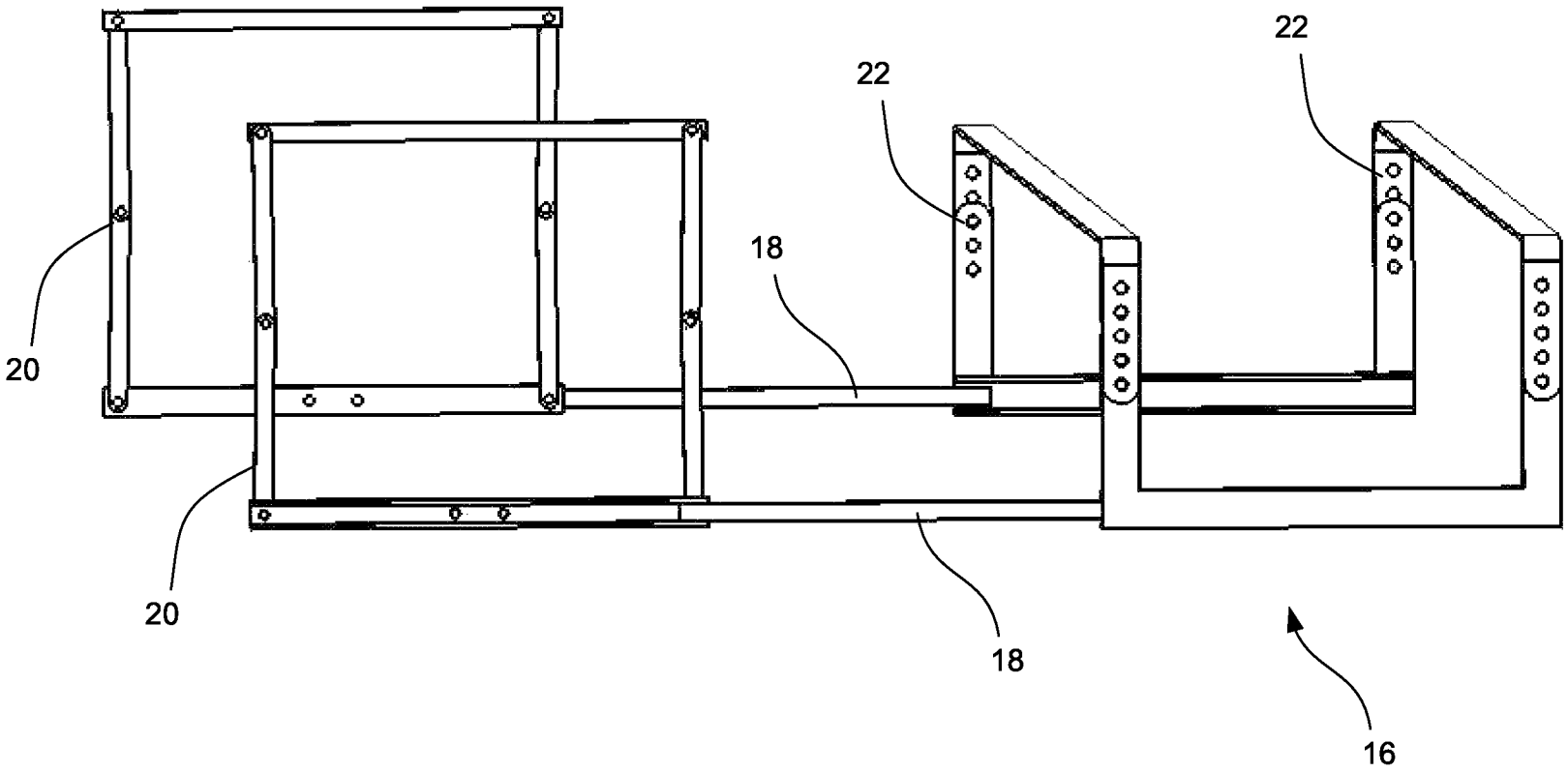
FIG. 9 shows a perspective view of an articulating mount from the gun safe of FIGS. 1-6 in the position of FIGS. 4-6.

To better illustrate features of the articulating mount 16, the exemplary embodiment of the articulating mount 16 is shown in FIGS. 6-9 disassociated from the bed 10. In FIG. 6, the articulating mount 16 is shown attached to the open lockable container 12 in the deployed or raised position, where the lockable container 12 would be raised adjacent the bed 10. FIG. 7 shows the articulating mount 16 in the storage position of FIGS. 1-2 without the lockable container 12. FIG. 8 shows the articulating mount 16 in the laterally extended position of FIG. 3, again without the lockable container 12 being shown. Finally, FIG. 9 shows the articulating mount 16 in the laterally extended position with the vertical displacement element raised to the position shown in FIGS. 4-5.

As may be seen from FIGS. 6-9, the articulating mount 16 of the exemplary embodiment includes support elements 22 that are configured to support the articulating mount 16 and the lockable container 12 on the frame elements of the bed 10 or other furniture item. The support elements 22 are an example of a fixed element to which the articulating element that is the articulating mount 16 is attached. In the illustrated embodiment, the support elements 22 each include a horizontal arm and two vertical arms descending from the horizontal arm and to which the movable portions of the articulating mount 16 are attached.

In the illustrated embodiment, the support elements 22 are configured to rest over the top of slats of the bed 10 and underneath the mattress, such that the weight of the mattress rests on top of the support elements 22 and prevents unwanted movement of the system. Optionally, the support elements 22 could be directly secured to the slats either above the slats or below, such as by way of screws, bolts, straps, or any other method or mechanism for securing known. While the support elements 22 may be configured to rest on top of furniture frame elements such as the bed slats shown in FIGS. 1-5, it will be appreciated that not all furniture permits such attachment. Therefore, the support elements 22 of some embodiments may be configured to rest on or be mounted to an underlying surface underneath an item of furniture, or the support elements may be configured to be secured to an underside of an item of furniture as discussed above.

As may be seen in FIGS. 6-9, the support elements 22 may be configured to be adjustable in size in one or more dimensions to permit adjustment of the location of the lockable container 12 when in the storage position and/or during lateral displacement of the lockable container 12. As an example of adjustability, the sides or vertical arms of the support elements 22 may be formed in sections with bolts or other connectors inserted into selected sets of aligned holes between the sections to secure the support elements 22 at a desired height. This vertical adjustability ensures that the lockable container 12 may pass underneath the side frame member of the bed 10 or a similar element of another item of furniture during lateral movement of the lockable container 12. Although not illustrated in the Figures, the support elements 22 may be adjustable in other dimensions to facilitate mounting or securing of the articulating mount 16 on or under the furniture item (such as to permit portions of the articulating mount 16 to pass between the slats of the bed 10).

Figure 10:
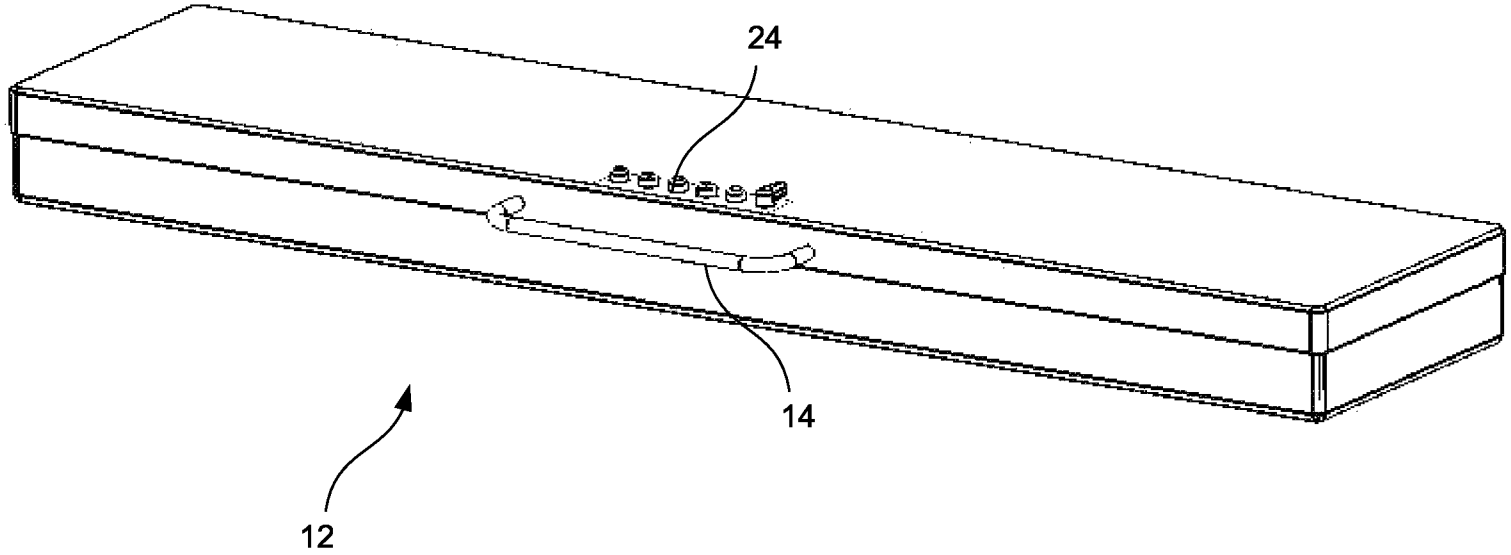
FIG. 10 shows a perspective view of a lockable container from the gun safe of FIGS. 1-6 in a closed position.
Figure 11:
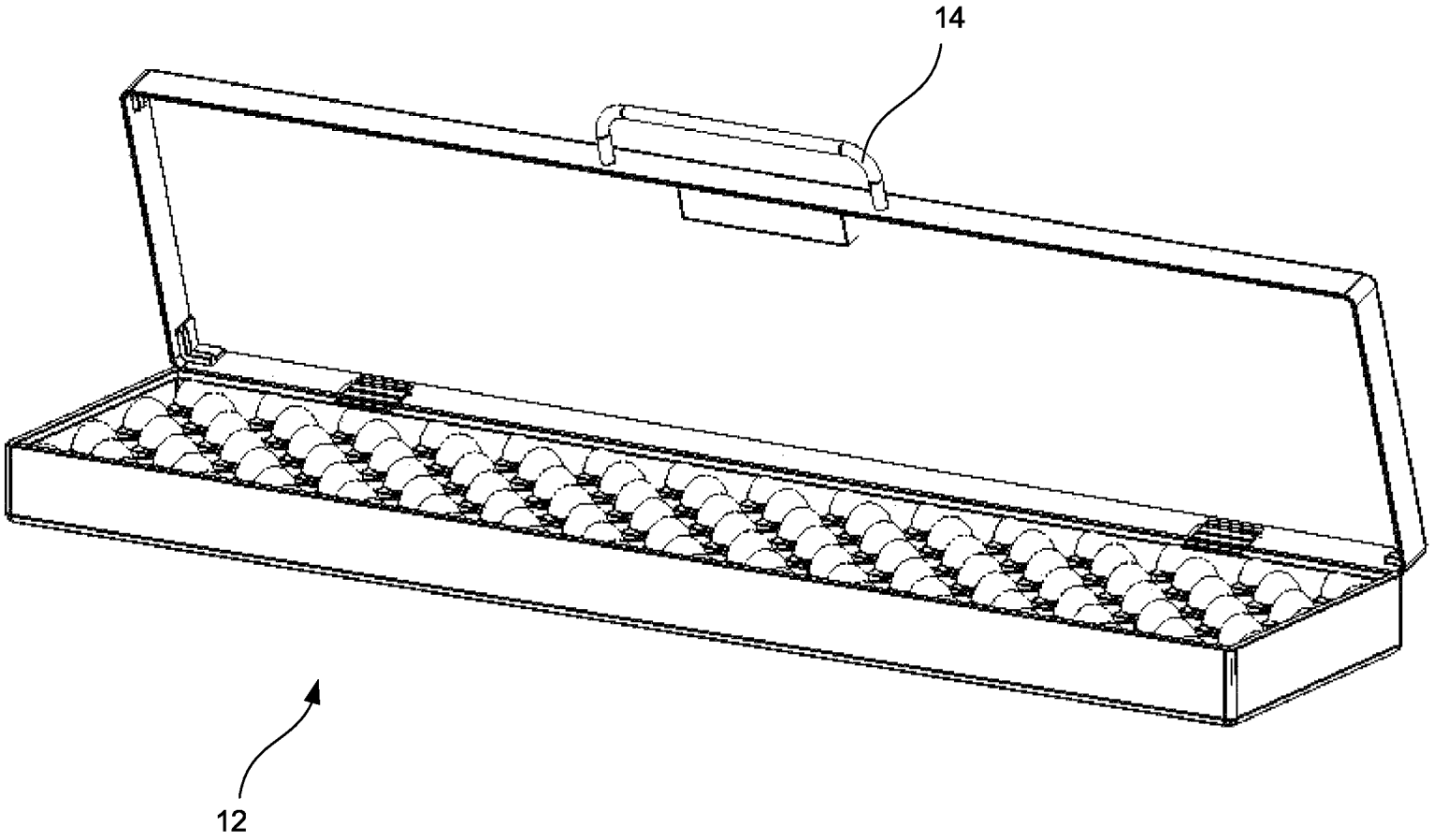
FIG. 11 shows a perspective view of a lockable container from the gun safe of FIGS. 1-6 in an open position.

While the lockable container 12 may take essentially any known form and configuration of devices now known to be used as lockable containers or later invented, and may use any locking mechanism now known or later invented or may even be configured without a locking mechanism if desired, FIGS. 10 and 11 show views of an illustrative lockable container 12, closed and open respectively. The illustrated lockable container 12 may be sized to be capable of holding long guns such as rifles, shotguns, and the like, as well as long knives, swords, machetes, or other weapons of the user's choice, or could be used to hold smaller weapons as well and/or valuables or essentially any other item. A lockable container 12 of this size might be well adapted for use under a user's bed or other item of furniture with a relatively large area. A smaller style of lockable container 12 might be capable of holding one or two handguns, knives, or other small weapons or items, and might be disposed underneath or as part of a smaller item of furniture, such as a nightstand.

As discussed previously, the illustrated embodiment of the lockable container 12 has the handle 14 to facilitate moving the lockable container 12 between the various positions discussed above. The handle 14 need not be present in all embodiments of the lockable container. As an example, the forces needed to effect the various movements of the lockable container may be sufficiently small that the handle 14 is not needed and may be omitted. In smaller embodiments, for example, the user might simply use friction between the user's hand and the bottom or other portion of the lockable container 12 to move the lockable container 12 between various positions. In other embodiments, a small indentation may be provided at some location on the lockable container 12 to receive the user's hand and facilitate the application of force to move the lockable container 12.

In some embodiments, it is envisioned that the lockable container 12 might be formed or covered so as to appear to be part of the item of furniture with which the gun safe is associated. For example, the front of the lockable container 12 might include a piece of wood stained, painted, or otherwise finished to resemble the remainder of an item of furniture. In some such embodiments, the piece of wood might hide the fact that the item of furniture has a gun safe associated with it. The gun safe may have a hidden latch to allow the gun safe to move from its stored position to be accessed in the manner discussed herein. As may be appreciated, a gun safe hidden and camouflaged to appear as part of a piece of furniture as discussed herein may further reduce the likelihood that the contents of the gun safe will be accessed by children or thieves. To best maintain the camouflage appearance of the gun safe in such instances, the handle 14 might be omitted from certain embodiments. Thus, the handle 14 is an optional feature of certain embodiments of the gun safe.

The lockable container 12 shown in FIGS. 10 and 11 also includes a lock 24, which is illustrated as a pushbutton combination lock. As is discussed above, where a lock such as lock 24 is present on the lockable container 12, the lock may be of any desirable type or combination of locks, such as a mechanical lock or an electronic lock or any combination of mechanical and/or electronic locks. A mechanical lock may include a pushbutton combination lock, a keyed lock, a dial combination lock, or any other type of mechanical lock. An electronic lock may include a keypad lock, a biometric lock, a keycard lock, a radio-frequency identification (RFID) lock, or any other type of electronic lock. The lock or locks chosen for the lockable container 12 may be selected based on a desired security level for the lockable container.

As described herein, embodiments of the gun provide convenient and secure access to contents of the lockable container 12. As discussed herein, embodiments of the gun safe provide access adjacent an item of furniture at a height that may be much more convenient than may be achieved without the vertical displacement features discussed herein. As may be appreciated, certain users or prospective users of the gun safe may find it difficult to bend over to access gun safes that do not incorporate the vertical displacement features discussed herein. Additionally, as certain users, for similar reasons, may find it somewhat difficult to reach under an item of furniture to access a gun safe. Therefore, certain embodiments of the invention may incorporate features to facilitate easier access to the gun safe. For example, a strap or other device may be attached to a portion of the lockable container 12 and extended from the lockable container 12 (in the storage position illustrated in FIGS. 1 and 2) to an easily-reachable position such as attached to the outer front of the bed frame. The user could grasp the strap and use it to pull out and then pull up the lockable container to make the movements discussed herein.

As another option, the gun safe may be provided with powered features that actuate the movements of the lockable container 12 as described herein. The powered features may include any powered mechanism known in the art, including one or more motors, hydraulic features, or any other powered mechanism known in the art or later invented for moving the lockable container 12 in the manner described herein. Thus, users of embodiments of the gun safe may trade the additional cost and weight associated with a powered gun safe to achieve the convenience of not having to reach under the item of furniture. A wired or wireless control may be provided to activate any powered features, or the powered features may be activated by voice command or other audible signal.

Embodiments of the invention therefore provide a gun safe configured to be mounted underneath a portion of an item of furniture and to be deployable from a storage position underneath the portion of the item of furniture into a readily-accessible position adjacent the item of furniture. The gun safe includes a lockable container sized to receive a weapon therein and an articulating mount configured to secure the lockable container underneath the portion of the item of furniture in the storage position. The articulating mount includes a fixed element configured to be fixed underneath the portion of the item of furniture and an articulating element attached between the fixed element and the lockable container, the articulating element being configured to facilitate movement of the lockable container from the storage position outward and upward to a deployed position adjacent the item of furniture.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A gun safe configured to be mounted underneath a portion of an item of furniture and to be deployable from a storage position underneath the portion of the item of furniture into a readily-accessible position adjacent the item of furniture comprising:

a lockable container sized to receive a weapon therein; and an articulating mount configured to secure the lockable container underneath the portion of the item of furniture in the storage position, the articulating mount comprising:

a fixed element configured to be fixed underneath the portion of the item of furniture; and an articulating element attached between the fixed element and the lockable container, the articulating element being configured to facilitate movement of the lockable container from the storage position outward and upward to a deployed position adjacent the item of furniture and comprising:

a lateral displacement element facilitating approximately linear outward movement of the lockable container until the lockable container is substantially adjacent the item of furniture; and a vertical displacement element facilitating substantially upward movement of the lockable container to an elevated position adjacent the item of furniture.

2. A gun safe as recited in claim 1, wherein the lateral displacement element comprises a component selected from the group consisting of:

a ball bearing glide;

wheels and guides; and a multi-bar linkage.

3. A gun safe as recited in claim 1, wherein the vertical displacement element comprises an element configured to secure the lockable container in the elevated position and further comprises a component selected from the group consisting of:

a ball bearing glide;

wheels and guides; and a multi-bar linkage.

4. A gun safe as recited in claim 1, wherein the fixed element is configured to rest on or attach to a surface underlying the item of furniture.

5. A gun safe as recited in claim 4, wherein the fixed element comprises a substantially inverted-U-shaped support element with a horizontal arm and two vertical arms connected to and descending from the horizontal arm, to which vertical arms the articulating element is attached.

6. A gun safe as recited in claim 5, wherein the vertical arms are adjustable in length to permit end-user adjustment of a vertical position of the lockable container in the storage position.

7. A gun safe as recited in claim 5, wherein the item of furniture is a bed comprising a bed frame and slats supporting a mattress, and wherein the horizontal arm of the support element is configured to rest on the slats of the bed under the mattress.

8. A gun safe as recited in claim 1, wherein the lateral displacement element is configured to provide linear displacement of the lockable container between the storage position and a low position adjacent the item of furniture.

9. A gun safe as recited in claim 1, wherein the fixed element comprises a closed loop comprising two spaced-apart horizontal arms adapted to contact the item of furniture, with U-shaped vertical arms connected to, descending from, and extending between the respective horizontal arms, the articulating element being attached to the U-shaped vertical arms.

10. A gun safe as recited in claim 1, wherein the vertical displacement element is configured to permit a gravitational force to bias the lockable container to the low position.

11. A gun safe as recited in claim 10, further comprising a reversible latching mechanism to latch the lockable container in the elevated position.

12. A gun safe as recited in claim 1, wherein the lockable container is sized to accommodate a firearm.

13. A gun safe as recited in claim 1, wherein the lockable container comprises a lid such that the lockable container is adapted to move between the storage position and the readily-accessible position while remaining in a locked state preventing access to contents of the lockable container in the absence of means to open the lockable container.

14. A gun safe as recited in claim 1, wherein when the lockable container is in the storage position, a major portion of the lockable container is substantially hidden from view by the item of furniture.

15. A gun safe configured to be mounted underneath a portion of an item of furniture and to be deployable from a storage position underneath the portion of the item of furniture into a readily-accessible position adjacent the item of furniture and outward and upward from the storage position, the gun safe comprising:

a lockable container sized to receive a weapon therein;

a fixed element configured to be fixed underneath the portion of the item of furniture; and an articulating mount attached between the lockable container and the fixed element and configured to secure the lockable container underneath the portion of the item of furniture in the storage position, the articulating mount comprising:

a lateral displacement element attached to the fixed element and configured to provide substantially linear horizontal movement of the lockable container; and a vertical displacement element attached between the lateral displacement element and the lockable container and configured to provide substantially upward vertical motion of the lockable container.

16. A gun safe as recited in claim 15, wherein the vertical displacement element comprises a bias mechanism to offset a downward gravitational force experienced by the lockable container.

17. A gun safe as recited in claim 15, further comprising a reversible latching mechanism to latch the lockable container in the elevated position.

18. A gun safe as recited in claim 15, wherein the lateral displacement element comprises a mechanism selected from the group of:

a glide;

wheels and guides; and a multi-bar linkage.

19. A gun safe as recited in claim 15, wherein lockable container comprises a lock selected from the group of:

a mechanical lock; and an electronic lock.

20. A gun safe as recited in claim 15, wherein when the lockable container is in the storage position, a major portion of the lockable container is substantially hidden from view by the item of furniture.

* * * * *